US006772806B2

(12) United States Patent
De Villele

(10) Patent No.: US 6,772,806 B2
(45) Date of Patent: Aug. 10, 2004

(54) INSTALLATION FOR FILLING RECEPTACLES WITH VARYING PRODUCT COMPOSITIONS

(75) Inventor: Damien De Villele, La Ferte Bernard (FR)

(73) Assignee: SERAC Group, La Ferte Bernard (FR)

( * ) Notice: Subject to any disclaimer, the term of this patent is extended or adjusted under 35 U.S.C. 154(b) by 0 days.

(21) Appl. No.: 10/361,617

(22) Filed: Feb. 11, 2003

(65) Prior Publication Data

US 2003/0150514 A1 Aug. 14, 2003

(30) Foreign Application Priority Data

Feb. 12, 2002 (FR) ..... 02 01690

(51) Int. Cl.[7] ..... B65B 43/42; B65B 1/04

(52) U.S. Cl. ..... 141/144; 141/103; 141/234; 141/104; 141/186; 141/248

(58) Field of Search ..... 141/144, 143, 141/142, 103, 104, 186, 99, 248, 234

(56) References Cited

U.S. PATENT DOCUMENTS 1,799,857 A 4/1931 Metzner
2,850,990 A * 9/1958 Rasmusson ..... 222/135
3,978,968 A 9/1976 Rose et al.
4,627,475 A 12/1986 Von Lersner
4,913,202 A * 4/1990 Miller et al. ..... 141/104
5,651,401 A * 7/1997 Cados ..... 141/186
5,713,403 A * 2/1998 Clusserath et al. ..... 141/104
6,286,717 B1 * 9/2001 Schmidhuber ..... 141/248

FOREIGN PATENT DOCUMENTS

EP 0 253 929 1/1988

* cited by examiner

*Primary Examiner*—Gregory L. Huson
*Assistant Examiner*—Khoa Huynh
(74) *Attorney, Agent, or Firm*—Young & Thompson

(57) ABSTRACT

An installation for filling receptacles comprises a rotary platform supporting a first filling station comprising a first feed vessel having first filling nozzles connected thereto, and at least one second filling station comprising a second feed vessel having second filling nozzles connected thereto, the second filling nozzles being adjacent to the first filling nozzles and the installation further comprising displacement members for imparting relative displacement between the receptacles and the filling nozzles.

5 Claims, 2 Drawing Sheets

INSTALLATION FOR FILLING RECEPTACLES WITH VARYING PRODUCT COMPOSITIONS

The present invention relates to an installation for filling receptacles that enables the receptacles to be filled with product in varying combinations of different ingredients.

BACKGROUND OF THE INVENTION

Document FR-A-2 809 377 discloses a receptacle-filling method comprising the steps of using a first filling station having a series of filling positions to fill each receptacle in part with a first ingredient, of transferring the receptacles to at least a second filling station likewise having a series of filling positions, and of finishing off the filling of each receptacle in succession with another ingredient. The "ingredient" of each station may itself comprise a respective mixture of ingredients.

A feed vessel is associated with each filling station so that by putting different ingredients in the different feed vessels, it is possible to modify the composition of the final product merely by modifying the proportions of the ingredients introduced in the receptacles in each of the filling stations, without it being necessary to modify the composition of the ingredient contained in each filling vessel.

In that document, the filling installation comprises a plurality of filling stations, each having a rotary platform supporting a series of filling positions. Each filling position has a filling nozzle and an associated weighing member.

In order to obtain the desired composition, the corresponding proportion of each ingredient is introduced into a receptacle in respective ones of the filling stations and the receptacles are transferred from one filling station to the other by means of transfer devices. The increase in the number of rotary platforms thus gives rise to increased cost and size of the installation so that such an installation can be justified only if large volumes of varying compositions are to be packaged.

Document U.S. Pat. No. 4,627,475 discloses a filling installation having filling nozzles connected to two distinct feed vessels each containing an ingredient to be packaged, each filling nozzle having two concentric pistons moving in a common chamber that is put into communication alternately with one and with the other of the two feed vessels. The common chamber is thus filled in succession with the two ingredients for packaging, and it is then emptied into a receptacle. Such an installation requires the common chamber to be large enough to contain the total quantity of product that is to be introduced into a receptacle, which means the installation is particularly bulky when receptacles are of large capacity. In addition, the ingredients for packaging are moved a first time in order to fill the common chamber and they are moved a second time in order to empty the common chamber into the receptacle, such that the rate of filling throughput is necessarily low.

OBJECTS AND SUMMARY OF THE INVENTION

An object of the invention is to provide an installation enabling receptacles to be filled with distinct products while reducing the cost and the size of the installation.

In order to achieve this object, the invention provides a receptacle-filling installation comprising a rotary platform supporting a first filling station comprising a first feed vessel having first filling nozzles connected thereto, and at least one second filling station comprising a second filling vessel having second filling nozzles connected thereto, adjacent to the first filling nozzles, the installation further comprising displacement members for imparting displacement to the receptacles relative to the filling nozzles.

Thus, each filling nozzle transfers one of the ingredients that is to be packaged directly into the receptacles, and a small displacement of the filling nozzle and the receptacles relative to one another suffices to enable the receptacles to be filled in part in each of the filling stations.

During the displacement of the receptacles relative to the filling nozzle, filling is necessarily interrupted. In an advantageous embodiment of the invention, one of the displacement members is disposed between an inlet transfer device and an outlet transfer device relative to the direction of rotation of the rotary platform. Thus, one of the displacements takes place over a fraction of the rotation of the rotary platform that is in any case unusable for filling, thereby minimizing dead times between filling stages.

BRIEF DESCRIPTION OF THE DRAWINGS

Other characteristics and advantages of the invention appear on reading the following description of a particular non-limiting embodiment of the invention given with reference to the accompanying figures, in which.

MORE DETAILED DESCRIPTION

Figure 1:
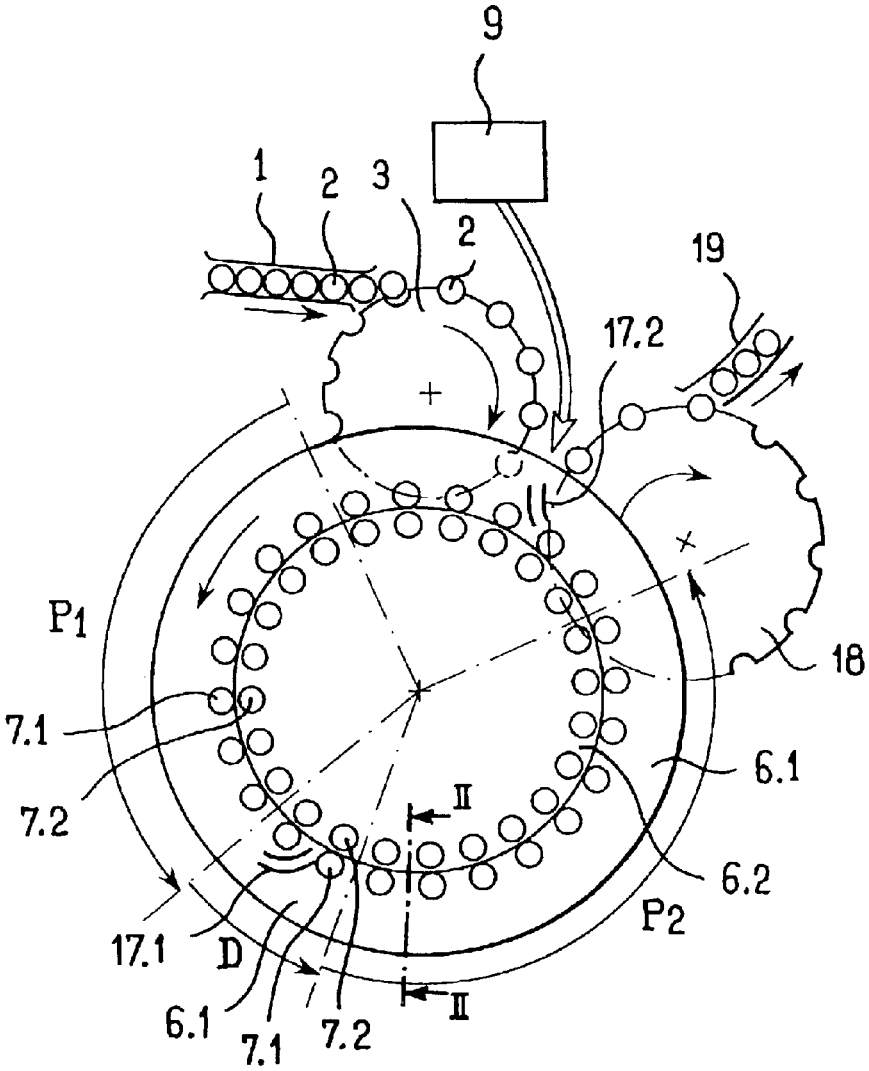
FIG. 1 is a diagrammatic plan view of a filling installation of the invention.
Figure 2:
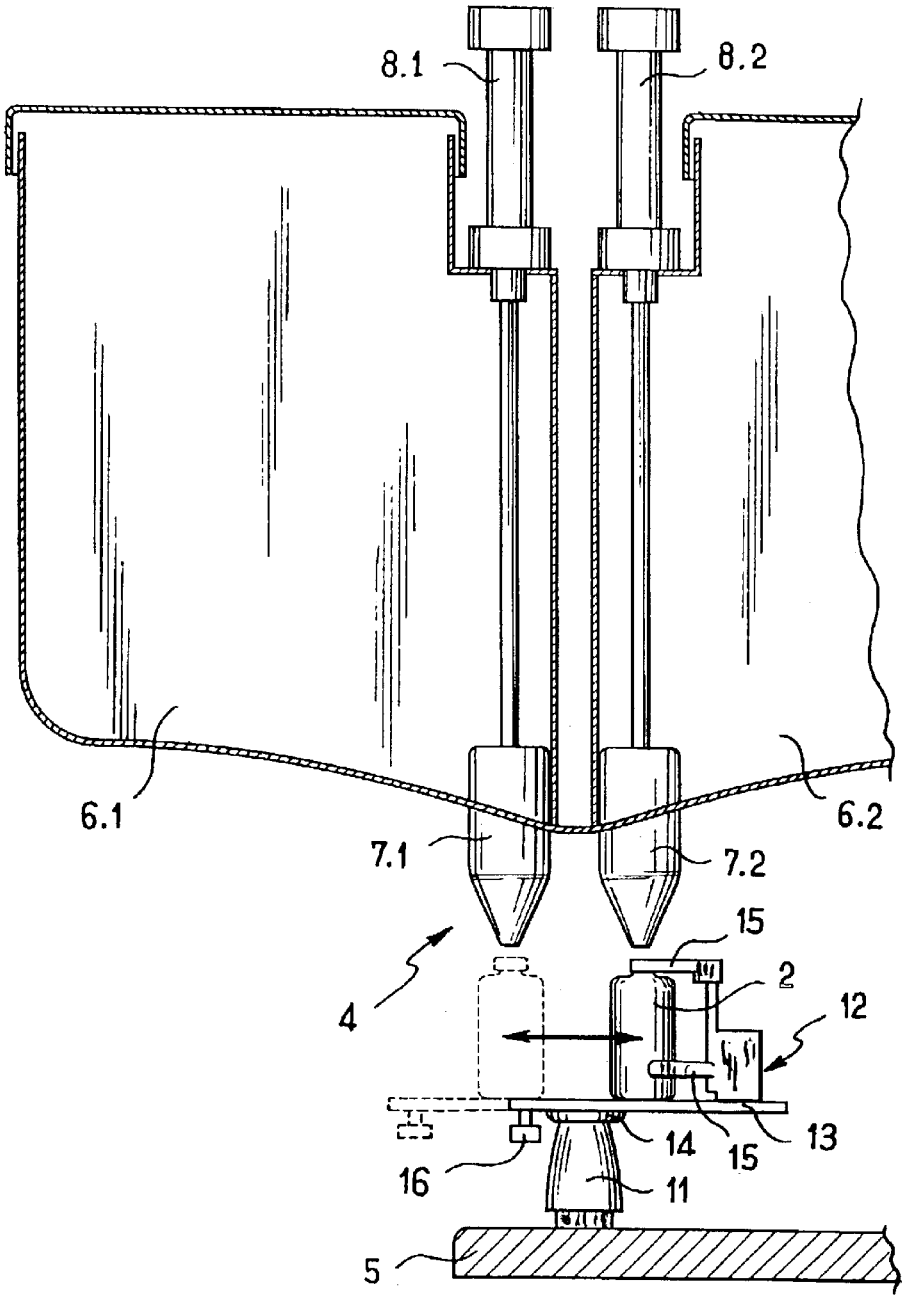
FIG. 2 is a fragmentary diagrammatic section view on line II—II of FIG. 1.

With reference to the figures, the installation comprises in conventional manner an inlet conveyor 1 delivering receptacles 2 to an inlet transfer device 3 which serves to introduce the receptacles 2 in succession to filling positions generally referenced 4, supported on a rotary platform 5.

In the invention, the rotary platform 5 supports both a first feed vessel 6.1 and a second feed vessel 6.2. In the embodiment shown, filling nozzles 7.1 forming a first series of filling nozzles are fixed to the first feed vessel 6.1 and filling nozzles 7.2 forming a second series of filling nozzles are fixed to the second feed vessel 7.2. The filling nozzles in each series are associated in pairs disposed radially relative to the rotary motion of the platform.

In conventional manner, the filling nozzles 7.1, 7.2 are associated with respective control members 8.1, 8.2 themselves associated with a control unit 9 which serves to control the filling nozzles 7.1, 7.2 over a functional connection represented by the double-line arrow in FIG. 1.

Each pair of filling nozzles 7.1, 7.2 is associated with a common weighing member 11 carried by the platform 5 and functionally connected to the control unit 9. Each weighing member 11 carries a support member given overall reference 12 having a plate 13 mounted to slide on the weighing member 11 in a radial direction of the rotary platform, e.g. by means of slideways (not shown) fixed to the weighing tray 14 of the weighing member 11. The support member 12 also has holding means 15 to ensure that the receptacles 2 are properly positioned while the platform 5 is rotating.

The plate 13 is positioned radially by a wheel 16 fixed to the plate 13 and co-operating with a first displacement member 17.1 (see FIG. 1) secured to the structure of the machine, and a second displacement member 17.2 also fixed to the structure of the machine.

With reference to the direction of rotation of the platform 5, the displacement member 17.1 is disposed at the end of a sector P1 corresponding to the receptacles being filled with the ingredient contained in feed vessel 6.1, and it is oriented in such a direction as to displace the support plate 13 radially inwards. Still with reference to the direction of rotation of the platform 5, the displacement member 17.2 is disposed between an outlet transfer device 18 and the inlet transfer device 3 and is oriented in a direction to guide the wheel 16 radially outwards.

In conventional manner, the transfer device 18 is associated with an outlet conveyor 19.

In FIG. 1, reference D designates a rotary sector of the platform within which no filling takes place, in order to allow the receptacles to move radially and the system to stabilize before filling starts again. Reference P2 designates a rotary sector of the platform during which the receptacles are filled with the ingredient contained in feed vessel 6.2.

When a filling position is in register with the inlet transfer device 3, the support plate 13 is in its radially outer position and the receptacle 2 introduced by the inlet transfer device 3 is thus vertically under a filling nozzle 7.1. As mentioned above, the receptacle is filled in part with the ingredient contained in the feed vessel 6.1 during displacement of the platform corresponding to the sector P1. The receptacle 2 is then displaced radially inwards by the displacement member 17.1 so as to bring it under the filling nozzle 7.2.

The receptacle is filled with the ingredient contained in the feed vessel 6.2 during rotation around the sector P2. From this position, the receptacle 2 is discharged by the transfer device 18 and the support plate 13 is then displaced radially outwards by the displacement member 17.2 so as to be ready to receive a new receptacle.

It will be observed that the sector D over which the plate 13 is displaced is a dead sector, i.e. a sector in which filling must be interrupted not only during the radial displacement proper, but also during a length of time after the displacement to allow the weighing member to settle. In order to minimize the disturbance caused, the filling nozzles 7.1 associated with the radially outer vessel 6.1 are mounted close to the radially inner wall thereof while the filling nozzles 7.2 associated with the vessel 6.2 are mounted to close to the radially outer wall of said vessel. In this manner, the filling nozzles 7.1 and 7.2 in each pair are adjacent to each other and displacement is reduced to a minimum.

Naturally, the invention is not limited to the embodiment described and the invention can be performed in a variety of ways that come within the ambit of the invention as defined by the claims.

In particular, when it is desired to adapt an existing machine to enable compositions to be varied by replacing a single feed vessel with a pair of feed vessels having two series of associated filling nozzles, it is generally not possible because of existing space constraints to modify the inlet transfer device and the outlet transfer device. Under such circumstances, it is necessary to place the second displacement member 17.2 immediately upstream of the outlet transfer device 18 relative to the direction of rotation of the platform so as to bring the receptacle 2 into its radially outer position in order to be removed from the platform.

Although the invention is shown with weighing members mounted so as to be stationary relative to the platform, it is also possible to mount the weighing members on the radially movable support member, particularly when the receptacles are supported by the neck.

Although the invention is described in association with support members 12 that are mounted to slide, it is equally possible to mount them so as to pivot about a vertical axis, with the positions of the filling nozzles being adapted correspondingly so that the receptacle is vertically beneath a filling nozzle during each filling stage.

When small quantities of various ingredients need to be added to a large volume of a main ingredient, the corresponding series of filling nozzles may be designed to meter by volume, thus making it possible to reduce the displacement sector, since there is no longer any need for the weighing member to settle in order to allow a corresponding measurement to be performed.

Provision can also be made to connect the filling nozzles to the feed vessels via hoses, in which case it is possible to move the filling nozzles so as to bring them in succession vertically over each receptacle which is kept stationary.

Although only two filling stations are provided in the installation described, the invention may be implemented with a greater number of filling stations in order to provide a greater variety of compositions in a given installation.

Naturally, the installation of the invention may also be fitted with a bar code sensor as described in document FR-A-2 809 377 in order to enable the composition introduced into each receptacle to be varied automatically.

What is claimed is:

1. An installation for weight filling receptacles, the installation comprising a rotary platform supporting a first filling station comprising a first feed vessel having first filling nozzles connected thereto, and at least one second filling station supported by the same rotary platform and including a second feed vessel, wherein the second feed vessel is connected to second filling nozzles adjacent to the first filling nozzles, the filling stations including a support member and a weighing member in common associated with a corresponding pair of the first and second filling nozzles, the first and second filling nozzles being connected to control members to cause the receptacles to be filled successively from each of the feed vessels, and wherein the installation further comprises displacement members for imparting relative displacement between the receptacles and the first and second filling nozzles.

2. A receptacle-filling installation according to claim 1, wherein one of the displacement members is located between an inlet transfer device and an outlet transfer device relative to a direction of rotation of the rotary platform.

3. A receptacle-filling installation according to claim 1, wherein the filling nozzles and the weighing members are mounted in fixed positions on the rotary platform, and wherein the support members are movable.

4. A receptacle-filling installation according to claim 3 wherein each support member has a support plate mounted on the corresponding weighing member.

5. A receptacle-filling installation according to claim 4, wherein the support plate is mounted to slide radially.

* * * * *